United States Patent [19]

Becker

[11] 4,207,067

[45] Jun. 10, 1980

[54] TRANSFER DYE

[75] Inventor: Carl Becker, Basel, Switzerland

[73] Assignee: Ciba-Geigy AG, Basel, Switzerland

[21] Appl. No.: 911,957

[22] Filed: Jun. 1, 1978

[30] Foreign Application Priority Data

Jun. 8, 1977 [CH] Switzerland ..... 7048/77

[51] Int. Cl.[2] ..... C09D 11/02

[52] U.S. Cl. ..... 8/470; 8/524; 101/470; 106/22; 428/195; 428/211

[58] Field of Search ..... 106/22; 8/2.5 A, 79; 101/470

[56] References Cited

U.S. PATENT DOCUMENTS 3,977,828 8/1976 Becker et al. ..... 8/79

FOREIGN PATENT DOCUMENTS 1572585 6/1969 France .

OTHER PUBLICATIONS

Chem. Abstracts, vol. 73, 1970, p. 50, Abstract No. 57147g.

*Primary Examiner*—Carman J. Seccuro

*Attorney, Agent, or Firm*—Wenderoth, Lind & Ponack

[57] ABSTRACT

The invention relates to the use of the dye of the formula

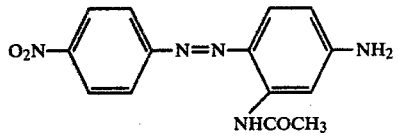

for transfer printing, and to printing inks and supports for transfer printing which contain, in addition to the customary constituents, the dye of the indicated formula, as well as to the material printed with the dye.

2 Claims, No Drawings

TRANSFER DYE

The invention relates to the use of the dye of the formula

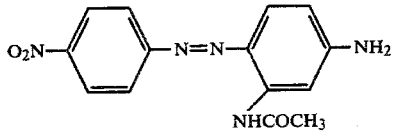

for transfer printing, to printing inks and supports for transfer printing which, in addition to the customary constituents, contain the dye of the indicated formula, and to the material printed with this dye.

It has been found that the dye of the above formula is preeminently suitable for the transfer printing process on a very wide variety of materials, for example cellulose triacetate, polyacrylonitrile, blends of polyester/resin-treated cotton, and especially polyester and qiana, and surprisingly produces strong orange prints of good lightfastness and excellent wetfastness properties on all these substrates. On account of its clear reddish orange shade, the product can be used as an individual dye as well as a basic component for obtaining brilliant golden yellow, orange, scarlet and red shades. Furthermore, very deep brown, navy blue and black shades can be obtained when the above dye is used in combination with suitable blue and other dye components.

The transfer printing process is known for example from French Pat. No. 1,223,330 and German Offenlegungsschrift No. 1,769,757. Dyestuff preparations for the process are disclosed for example in German Offenlegungsschrift No. 1,771,813 and corresponding supports are disclosed in German Offenlegungsschrift Nos. 1,771,812 and 2,443,063.

The dye of the present invention is known, as is also its suitability for dyeing polyester from an aqueous bath. However, it was unexpected that the dye would have good sublimation properties and that it would be possible to produce with its strong sharply defined prints on all the above mentioned substrates. In addition, the dye surprisingly also makes it possible to produce readily pourable printing pastes having a low content of electrolytes and dispersants and a high concentration of dye and which are much in demand on account of the small amount of printing paste which is applied to paper.

The invention is illustrated by the following Examples, in which the parts and percentages are by weight unless otherwise stated.

EXAMPLE 1

7.5 parts of a dyestuff preparation consisting of 75% finely dispersed dye of the formula

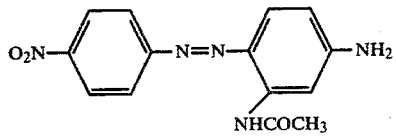

and 25% ethyl cellulose (Ethocel® N7, Dow Chemicals) and prepared in a trough kneader (Werner Pfleiderer) are intensively dispersed for 10 minutes in 100 parts of a gravure printing lacquer consisting of 90 parts of ethyl alcohol, 5 parts of methyl ethyl ketone and 5 parts of ethyl cellulose, using a toothed disc stirrer.

A stable printing ink dispersion having a viscosity of 22" (measured in a Ford 4 viscosity cup) is obtained. A transfer printing paper is printed with this ink in a desired pattern using a gravure machine (intaglio printing) and the print is dried.

The dried orange red print has good fastness to rubbing and can be transferred with sharp definition by bringing the printed side of the transfer paper into contact with a polyester satin woven or printed fabric on a transfer printing calender for 30 seconds at a running speed of 7 m/min, a temperature of 210° C., and exerting a pressure of ~100 g/cm$^2$. The resulting strong orange print on a white ground is fast to light, washing, perspiration, and rubbing.

A print obtained with a mixture consisting of 84 parts of the yellow dye of the formula

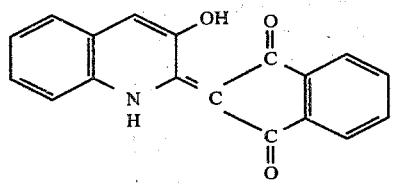

and 16 parts of the red dye of the formula

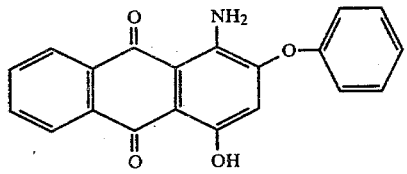

is very close to the orange shade obtained with the dye of this Example, but is much less strong (about 80:100) on using the same amount of dye.

EXAMPLE 2

Using an impeller, 15 parts of an aqueous dispersion of the dye of the formula indicated in Example 1, which is prepared according to German Offenlegungschrift No. 2,520,527 and contains 45% by weight of dye, are stirred into 985 parts of a stock thickening of the following composition:

50% of sodium alignate, 5% aqueous solution
45% of water, and
5% of white spirit.

The deaerated printing paste is applied with a doctor blade to a readily absorbent transfer paper as support on a vacuum table with a screen of size 62 monofilament gauze. The printed side of the dried support is laid on a fabric of qiana filament and treated on an ironing press at 200° C. for 30 seconds. The resulting orange print on a white ground is strong, sharply defined, and light- and wetfast.

EXAMPLE 3

15 parts of an aqueous preparation containing 50% of the dye of the formula of Example 1 and obtained according to German Offenlegungsschrift No. 2,520,527 are diluted with 15 parts of a 1:1 mixture of desalinated water and ethyl alcohol and, with intensive stirring using an impeller, added to 120 parts of a stock solution consisting of 78 parts of ethyl alcohol
24 parts of water and
3.6 parts of oxypropyl cellulose (Klucel® E, Hercules) dissolved therein, and
14.4 parts of a 30% aqueous solution of a copolymer based on vinyl pyrrolidone (Collacral® VL, BASF).

The resulting rapidly drying aqueous-alcoholic printing ink has a viscosity of 26" (measured in a Ford cup No. 4).

Prints obtained with this printing ink on a paper printing machine with a cylinder engraved for half-tone engravings (engraved to a depth of 30μ) are fautless, i.e. they dry very rapidly with firm adhesion and are free from bubbles.

A sharply defined, strong orange light- and wetfast print is obtained by laying the printed side of the dried support on a polyester satin woven fabric and heating for 30 seconds at 210° C. on a blade press.

A sharply defined brown print of similarly good general fastness properties is obtained by repeating the procedure of this Example using a mixture consisting of 8.5 parts of the above dyestuff preparation and 6.5 parts of a dyestuff preparation correspondingly prepared with the dye of the formula

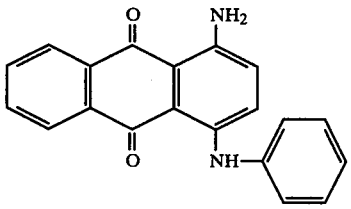

EXAMPLE 4

A paper web is printed by the flexographic process with a printing ink which consists of 10 parts of the dye of the formula of Example 1, 3 parts of a urea/formaldehyde resin (Uresin® B), 60 parts of a 15% polyvinyl butyral resin solution in ethyl alcohol (Mowital® B30H solution) and 22 parts of ethyl alcohol.

The dye is triturated in a closed bead mill (DYNO MILL) with 1 mm quartzite beads until the particle size has been reduced substantially to below 5μ.

This printing ink effects on transfer printing paper prints which are fast to rubbing and which can be transferred on a calender at a temperature of 200° to 210° C. during a contact time of 30 to 35 seconds in a very high colour yield to a polyester or qiana woven or knitted fabric, and at 195° to 200° C. to a cellulose triacetate or polyacrylonitrile flat-surface structure. A strong, bright orange shade of very good general fastness properties is obtained.

EXAMPLE 5

The printed side of a dried paper web which has been printed in accordance with the particulars of Example 4 is brought into contact with a polyester/cotton blended fabric (50:50) which has been pretreated with a reactant resin in accordance with Example 2 of German Offenlegungsschrift No. 2,436,783, and support and fabric are heated on a transfer printing calender for 20 seconds at 220° C. exerting a contact pressure of ~100 g/cm². The dye transfers in exceedingly sharp definition in virtually the same shade and depth of colour to both fibre components of the blended fabric. The resulting orange print on a white ground is very strong and fast to washing, persipiration and light.

EXAMPLE 6

11.2 parts of ketone resin (acetophenone resin) and 8 parts of ethyl cellulose (Ethocel N7, Hercules) as well as 350 parts of dry dye of the formula

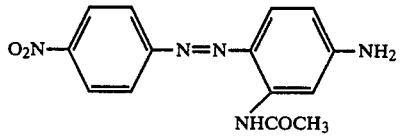

are stirred into a solution of 10 parts of a fatty alcohol polyglycol ether obtained from cetyl/stearyl alcohol and 25 moles of ethylene oxide (Marlipal 1618/25, Hüls) and 40 parts of formaldehyde condensate of sodium naphthalenesulphonate (Tamol NNOK-SA, BASF) in 580.8 parts of water. The ketone resin, in pellet form, and the ethyl cellulose flakes are ground to a fine dust in a laboratory mill before they are stirred in. The stirred batch is ground for 4 hours in a bead mill with quartzite balls of 1 mm diameter and the particle size of the dye is reduced substantially to below 5μ. After removal of the grinding elements, 900 parts of the grinding stock are mixed with 900 parts of water-saturated 2-butanol (regenerated material) consisting of about 643 parts of 2-butanol and 257 parts of water, and the mixture is stirred for 1 hour. A mixture consisting of two liquid phases is formed. The ketone resin and the ethyl cellulose dissolve in the water-saturated 2-butanol phase. Simultaneously the finely ground dye also flushes into this organic phase. After 1 hour the solvent phase is annulled by stirring in 6000 parts of cold water and the resulting fine granulate is collected with suction and carefully washed on the suction filter. The dye content of the moist granular resinated filter cake is 44%.

600 parts of this filter cake are stirred with 112 parts of 1,2-propylene glycol, 12 parts of ligninsulphonate and 25 parts of a non-ionogenic copolymer of ethylene oxide and propylene oxide and the mixture is ground for 14 hours in a bead mill with quartzite balls of 1 mm diameter. The dispersion separated from the grinding elements has an outstandingly good shelf life. After a storage time of several months, the filter test of this preparation shows it still to be in perfect condition. Even after being kept for 14 days in a hermetically sealed vessel in a heating cabinet at 60° C., the paste remains highly fluid and there are no signs of an incipient dyestuff recrystallisation.

By repeating the above procedure, but without the addition of ketone resin and ethyl cellulose during the stirring of the dye, then the resulting liquid dispersion contains a very marked proportion of needle-shaped recrystallised dye as sediment after only a short time (14 days storage at room temperature or after 12 to 14 days at 60°). Because of this recrystallisation, the dispersion can no longer be filtered and is thus unusable.

What is claimed is:

1. In the method for the dry transfer printing of textile material which comprises contacting the material to be printed with the printed side of a printed transfer carrier support and subjecting the carrier support to heating while in contact with the said material to effect transfer of dye-stuff from the carrier support to the said material, the improvement according to which the printed transfer carrier support carries a print comprising a dyestuff of the formula

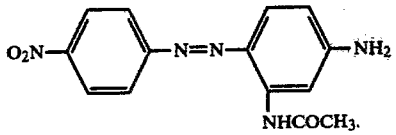

2. In a carrier support for use in dry transfer printing which comprises a base sheet carrying a print susceptible for dry transfer to a textile material, the improvement according to which the print comprises a dyestuff of the formula

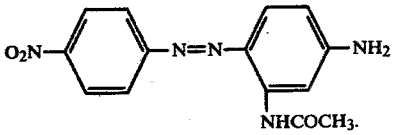

* * * * *